United States Patent [19]

Winrow

[11] 3,942,274

[45] Mar. 9, 1976

[54] STRIP MODULE FOR SIGN ELEMENT

[75] Inventor: Donald Winrow, Weston, Canada

[73] Assignee: Ferranti-Packard Limited, Toronto, Canada

[22] Filed: Apr. 15, 1974

[21] Appl. No.: 460,699

[52] U.S. Cl. ..... 40/28 C; 40/52 R; 340/373

[51] Int. Cl.[2] ..... G09F 11/34

[58] Field of Search ..... 40/28 C, 28 R, 23 R, 52 R, 40/53 R, 132 R, 132 D, 140, 142 R, 143; 340/373

[56] References Cited

UNITED STATES PATENTS

| | | | |
|---|---|---|---|
| 3,022,591 | 2/1962 | Faulkner | 40/140 |
| 3,059,363 | 10/1962 | Mack | 40/140 |
| 3,140,553 | 7/1964 | Taylor | 40/28 C |
| 3,199,098 | 8/1965 | Schwartz | 340/324 |
| 3,236,204 | 2/1966 | Joseph | 40/143 X |

*Primary Examiner*—Richard C. Pinkham
*Assistant Examiner*—Vance Y. Hum
*Attorney, Agent, or Firm*—Westell & Hanley

[57] ABSTRACT

A plurality of longitudinally extending mounting elements are designed to mount in a single row a plurality of magnetically actuable display elements. Each of the mounting elements is designed to be located side by side and in close proximity to other row mounting elements of the same type and at each end is provided with couplings designed to couple the element to a member extending transversely thereto. The coupling elements and the transversely extending member are so arranged that a plurality of the coupling elements located side by side may be coupled to the transversely extending member. Energizing windings for individual magnetic control of each of the display elements is provided rearwardly of the row elements. Thus the windings for all the row elements may be applied while the elements are arranged end - to - end and the elements may then be rotated parallel to each other, with the windings attached for assembly to the transverse member.

5 Claims, 7 Drawing Figures

STRIP MODULE FOR SIGN ELEMENT

This invention relates to a method of constructing a magnetically actuated array of display or indicating elements. By the term 'display elements' herein I refer not only to arrays where the elements collectively form a symbol or design but also to arrays where the status of each individual element conveys intelligence.

The operating principles of the display or indicating elements used in the array will not be dealt with in detail here because these operating principles are discussed in such U.S. Pat. Nos. as:

| | | | |
|---|---|---|---|
| 3,283,427 | issued | Nov. 8, 1966 | to Ferranti-Packard Ltd. |
| 3,295,238 | " | Jan. 3, 1967 | " |
| 3,303,494 | " | Feb. 7, 1967 | " |
| 3,365,824 | " | Jan. 30, 1968 | " |
| 3,518,664 | " | June 30, 1970 | " |
| 3,624,941 | " | Dec. 7, 1971 | " |
| 3,140,553 | " | July 14, 1964 | " |
| 3,469,258 | " | Sept. 23, 1969 | " |

As disclosed in these patents in more detail, the display or indicating elements comprise a flat disc element (usually but not necessarily round) contrastingly colored on opposite sides and rotatably mounted to display alternate ones of its sides in a viewing direction depending upon its orientation. A magnet mounted on the element with its axis to some degree transverse to the magnetic axis allows control of the altitude of the element by an exterior magnetic field. The exterior field is supplied by one or two pole pieces whose polarity is determined by one or more energizing windings. (Most of the advantages of the invention described herein accrue when two pole pieces are used). The energizing windings must be located in close association to the pole pieces of the magnetic circuit of which they form a part.

Such arrays of display or indicating elements have been useful and successful and, as a number of the aforementioned patents make clear, these are most commonly arranged in rows and columns whereby by selective actuation, letters, numbers or other symbols or designs may be displayed collectively by the elements in the array.

Problems have been encountered in assembling the rotating elements and pole pieces in such an array and in particular in applying the energizing windings to such array which may have seven rows and five columns embodying 35 elements in all.

It has been found that the production, assembling and especially the wiring of arrays of this type is facilitated if the base for the array, on which the pole pieces and display elements are mounted, is not made as a unitary body. Procedures encountered in the manufacture of the array are much simplified (in accord with this invention) if the base is made of a series of longitudinally extending strip members each corresponding to a single row (the term 'row' is herein interchangeable with 'column') of elements in the array. These members are referred to herein as 'row mounting members' or as 'strip modules' and are designed to be used as modular units to be assembled side by side to provide an array. Assembly of the strip modules is achieved by providing longitudinally extending members arranged to extend transverse to the strip members and located at each end of the latter and to be coupled to each of the strip members whereby the latter are coupled to each other. The coupling may be achieved in any of a number of ways, two of which are illustrated in the preferred embodiment.

The design of the base member in strip modules to be later assembled side by side, greatly facilitates the assembly of the array. These advantages largely accrue from the fact that each strip module carries only a single row of display elements.

The principle advantage exists in those cases where there are two pole pieces per display element and these pole pieces form part of a magnetic circuit extending rearward of the array and including a junction member joining the pole pieces in a magnetic circuit, and where there is defined a space when viewed longitudinally of the strip element, bounded by the magnetic circuit, connected to the pole pieces and the back of the array. Energizing windings pass through the space to provide energization for determining the polarity of the pole pieces. (The term 'winding' is used to include the arrangement where the energizing wire forms a partial turn, less than a complete turn about the magnetic circuit).

Wires of energizing windings are passed through the space separating the array and the magnetic circuit for energizing the pole pieces. In some alternatives a wire, corresponding to each character which, selectively, may be portrayed by the array, is passed through the magnetic circuit for each element (assuming a given polarity for energization of the wire), in a sense dictated by the color of the character to be displayed. The assembly of the device is found greatly simplified, where the strip modules are provided with magnetic circuits defining the said space and provided with energizing windings before assembly in an array.

The provision of energizing windings and pole pieces is a comparatively easy operation with the strip modules of the present invention, since the strip modules may before assembly be laid end to end and magnetic circuits, (including pole pieces) and energizing windings assembled thereto. This is vastly easier than applying pole pieces and energizing windings in a rectangular array. Although the above comparison is true whether the winding is manual or automatic it is particularly true where the winding is done by a loom of the type shown in U.S. Pat. No. 3,283,427, referred to above or by a device operating under similar general principles. With the pole pieces and windings assembled to the modular strips, while arranged end to end as above described, and with the provision of sufficient length of the windings between the endwise-arranged members, these members may be simply laid beside each other, each one rotated to bend the windings 180° relative to the one before (successive bendings being in opposite directions) to allow the modular strips to be coupled beside each other in a modular array.

A particular type of magnetic loop for use in the assembly of the modular strips while laid end to end is the shape formed when magnetic members project rearwardly from the two pole pieces to a bight, the shape formed with arrangement being as if the bight were rotated 180° about an axis parallel to the pole pieces. The resultant shape, when viewed longitudinally along a strip module, is a cross in the magnetic members between the rear face of the strip module and the bight so that wires may be threaded inside the bight on both sides of the cross. This allows for simple flexibility of winding since it will be noted that wires on opposite sides of the cross give opposite energization for current flow in the same direction.

The strip modules render production more effective whether or not the winding types described are used since the strip modules facilitate other assembly techniques. Whether the pole pieces are inserted by normal or automatic means but particularly in the latter case, the strip modules are more easily handled for mounting such pole pieces than a rectangular array. Similarly if, instead of windings extending through all the elements in an array, if X-Y (row and column) energization is used with two separable magnetic coupling members mounted to join each pair of pole pieces, (as disclosed in U.S. Pat. No. 3,303,494) then it is found easier to couple the pole piece members to the strip members when the latter may be handled singly before assembly.

In drawings which illustrate a preferred embodiment of the invention:

Figure 1:
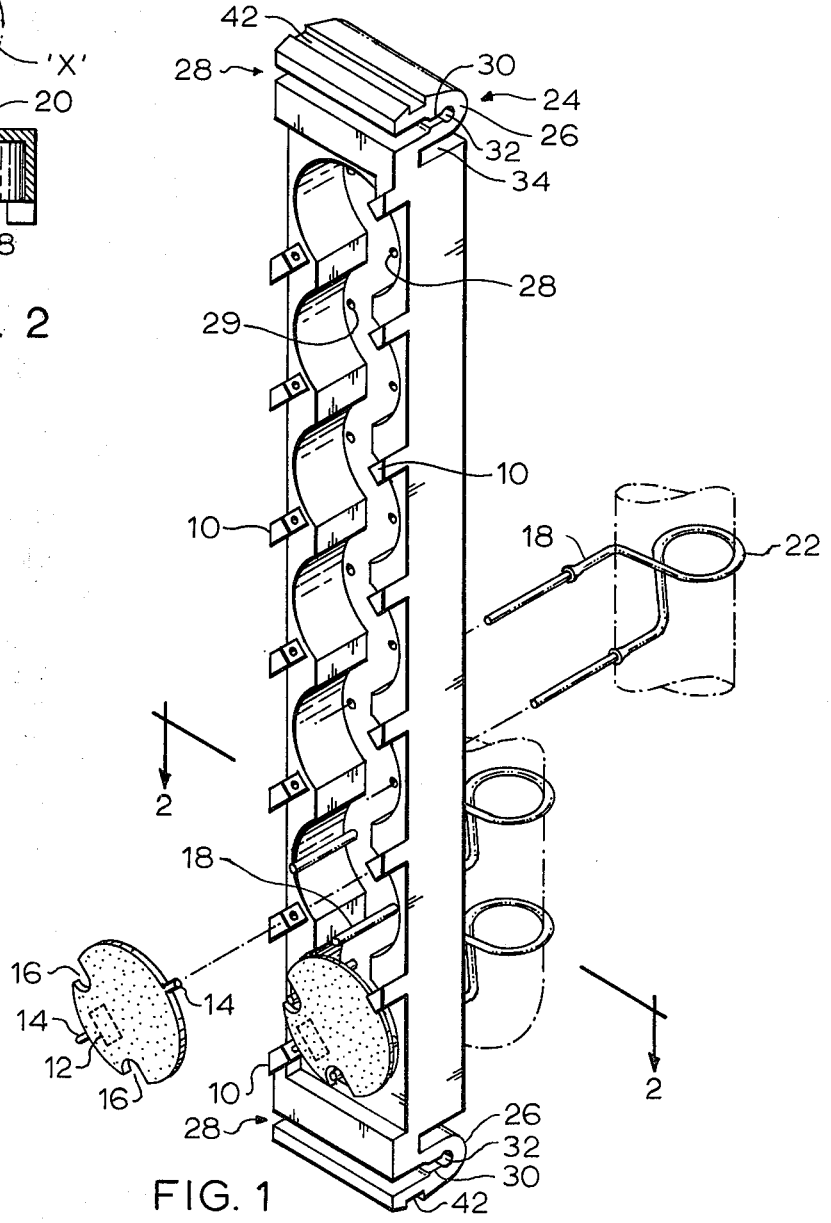
FIG. 1 shows a perspective view of a strip module in accord with the invention.
Figure 3:
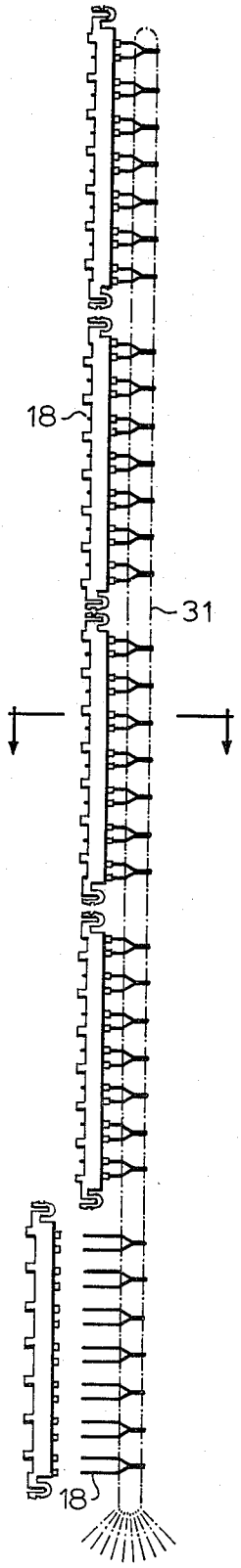
Figure 4:
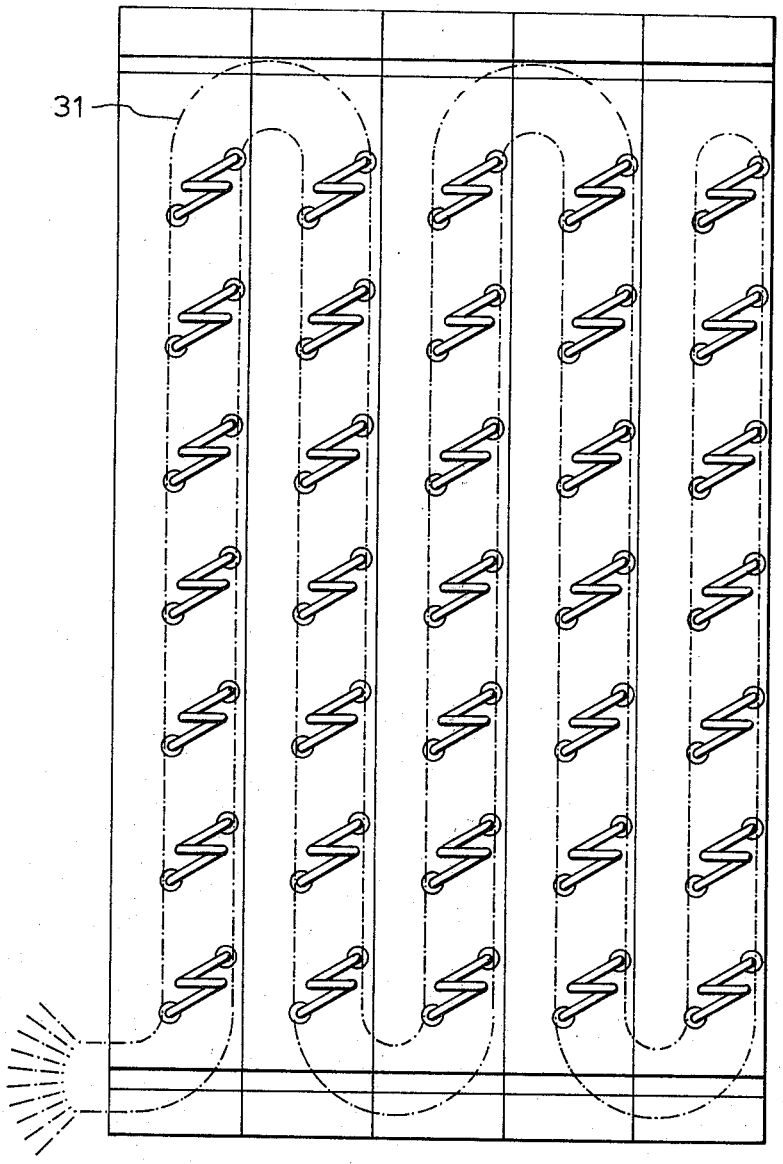
Figure 5:
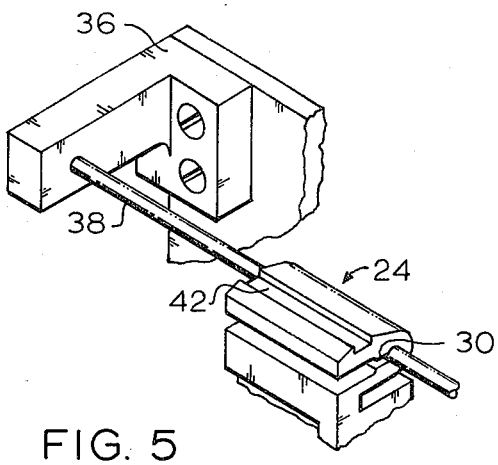
Figure 6:
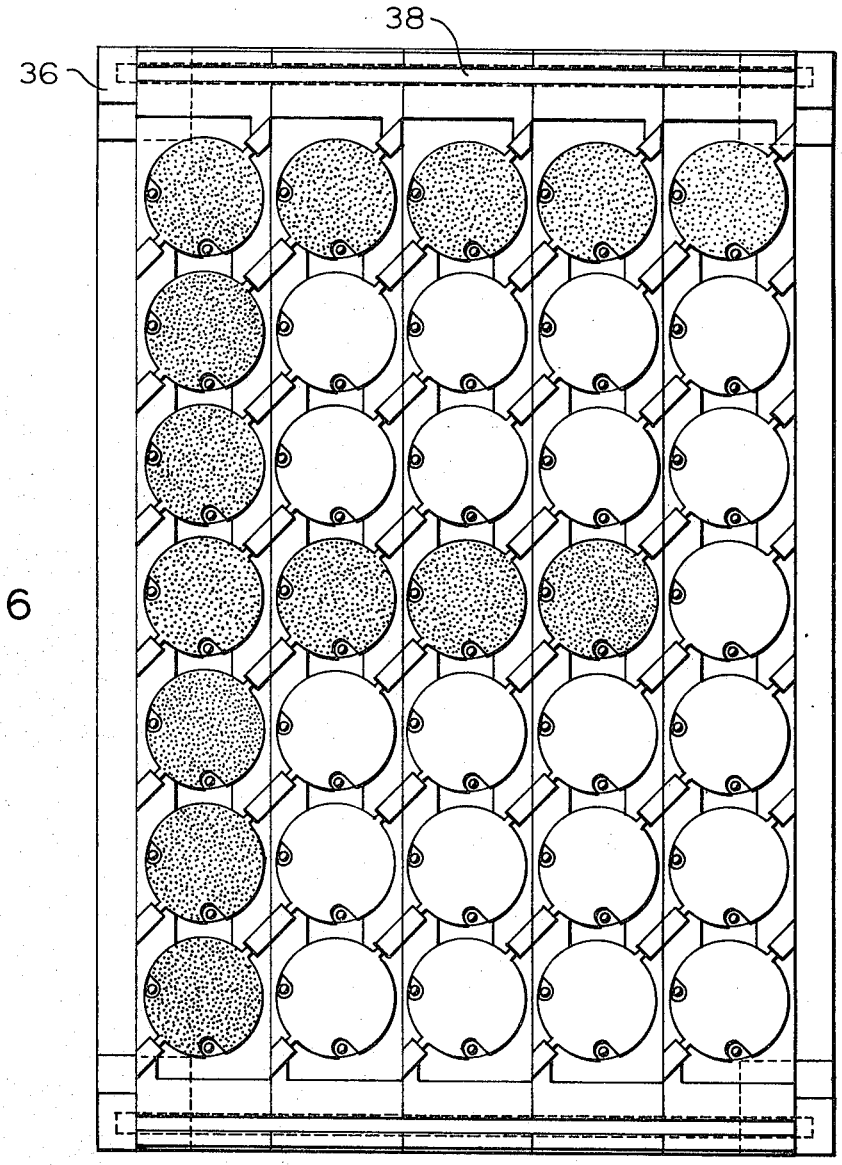

FIG. 3 schematically indicates the winding of loops with a loom;

FIG. 4 shows (from the rear) the modules in accord with FIG. 1 arranged in an array;

FIG. 5 shows a means for attaching the modules in accord with FIG. 1 to a base;

FIG. 6 shows (from the front) an array of modules so attached; and

Figure 7:
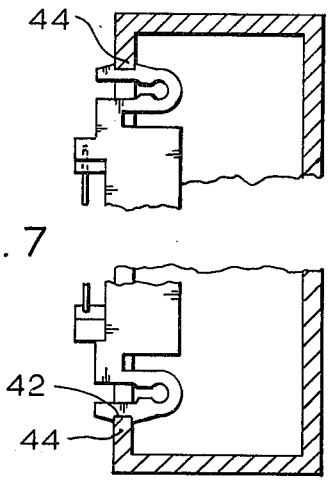

FIG. 7 shows an alternative means of attaching the module.

In the drawings the strip module or 'row mounting element' is designed to house the disc display or indicating elements in one row of the array. Here the array comprises 35 elements in five rows and seven columns. (The terms row and column being interchangeable herein). The strip module, designed preferably, as here, to extend in the longer dimension of the array, provides on its forward side, seven pairs of pin mounts 10 for the pins 14 of rotary mounted display or indicating disc elements arranged, in accord with the invention, in the module in a single row. The axes of the disc elements, for compactness of their arrangement in the array, are mounted to be oriented at 45° to the longitudinal axis of the module. The modules, as shown, are recessed to provide for rotation of the elements. Magnets 12 as indicated in FIG. 1 are mounted on the element and extend transversely to the axis thereof approximately one quarter of the way along the circular disc from one pin 14. The disc is recessed at 16 to allow passage of the pole pieces 20. In the design techniques presently employed, it is preferred for construction economy to use constant pole piece spacing with different sizes of disc. Thus the poles and the recesses will appear progressively closer to midway between the pins as the size of the disc progressively decreases, and the recesses will appear progressively closer to one of the pins as the size of the disc progressively increases. An alternative where only one recess is provided is shown in U.S. Pat. No. 3,295,238. Other alternatives are shown in the other patents already listed. In the embodiment shown at the positions as dictated by the magnet and cutout locations, the strip module is apertured at 29 to provide for the passage therethrough of pole pieces. The strip modules may be made of any material but plastic has been found most suitable. In the design, the pole pieces 18 may be inserted manually in holes 29 premolded in the strip module, such insertion occurring at the time hereinafter described and the pole pieces being preferably held in place by friction and a slight resilient bending of the pole pieces on insertion. (The strip module may be used with a single pole control and magnet of the type shown in U.S. Pat. No. 3,469,258 referred to above, although the principal advantages of the invention accrue from the use of the double pole-piece arrangement described herein in detail.) In the arrangement shown, the pole piece pairs, projecting rearwardly from the array, must be linked, rearwardly of the array, by a magnetic joining member in a magnetic circuit, to be energized by windings in proximity thereto. Although the strip module herein described, may be used with the double junction clips and X-Y energization described in my U.S. Pat. No. 3,303,494, the principal advantages accrue from the use of the windings wherein an energizing wire for each character is directed relative to all element magnetic circuits to selectively energize each one or the other sense to produce the combination of light and dark elements designed to produce, in the completed array, the character in question.

For example, the 'F' formed in FIG. 6 would be created by a single wire running through and energizing all the pole pieces in the array and respectively energizing them to create the black and white arrangement as shown in FIG. 6. A wire will therefore be provided corresponding to each letter or character to be displayed, to selectively energize the pole pieces to produce the symbol. The magnetic qualities of the pole pieces are designed to provide sufficient magnetic remanence to allow the winding to be pulsed and to retain the polarity applied after cessation of the pulse. Thus, of a plurality of windings through a magnetic loop, the pulsing and resultant polarity of the pole pieces created in the array windings by the last wire pulsed, controls the polarity of the pole piece pairs, unaffected by the presence of the other windings until there is a later pulsation by another winding.

A magnetic element, joins the rearwardly directed pole pieces into a single magnetic circuit, rearwardly of the strip module, and space is provided between the magnetic circuit rearwardly of the strip module to pass or wind the energizing winding. In the preferred embodiment of the invention the two pole pieces and the junction member are integral and one length of suitably selected ferromagnetic material. One of the great advantages of the invention is that the pole pieces and energizing windings may be applied to the modules while these are arranged end to end. This is shown schematically in FIG. 2 where, as schematically indicated, the windings 31 are first attached to the magnetic circuits (as indicated in the left hand strip module) and the strip modules in end to end relation are then applied to the pole pieces 18 which stick through the moulded holes 29 in the strip module. Sufficient length of winding 31 is provided that the strip modules with the windings attached may be rotated at 180° each in an opposite direction to the previous one to be arranged in a rectangular array as indicated schematically in FIG. 3. The sense in which the windings are applied to the pole pieces is of course arranged to take these subsequent assembly arrangements into account.

Although the strip modules and the winding arrangement of applying the winding and pole pieces to the modules while arranged end to end, is particularly suited to the use of a loom as disclosed in U.S. Pat. No. 3,283,427 or to a similar device for assisting application of the windings in selected polarity; the application of the windings is simplified with the strip modules described, even when the application of the windings to the pole pieces or of these to the strip module is manually or otherwise applied.

Figure 2:
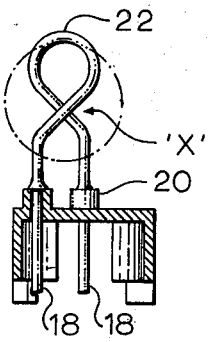
FIG. 2 shows a cross section of the strip module of FIG. 1 looking lengthwise along the strip module.

Although the magnetic junction member joining the elements in a magnetic circuit may be of various shapes for various applications and assembly requirements, the use of strip modules is particularly suitable for use with the form of pole piece and junction members shown in FIG. 2. In the preferred form, the pole pieces 18 and junction member are an integral piece of magnetic material having a suitable magnetic remanence to retain its polarity after pulsing. The pole pieces 18 are provided with straight extents 20 to pass through the proper holes in the strip module to meet rearward of the module in a bight 22. The shape which is felt to be inventive is thought best described as the result obtained applying to the bight 22 of such a member an approximate 180° twist so that about an axis parallel to the straight extents of the pole pieces, when viewed longitudinally of the element, the pole piece members cross at ('X', FIG. 2) between the back of the array and the bight 22 with space for energizing windings between the magnetic circuit and the module either above or below the cross 'X'. The ease for selective application of windings to the magnetic circuit will be readily apparent. A winding designed to energize a pole piece in one or the other sense may be led (generally longitudinally of the element) above or below the cross members but a given sense of pulsing in such winding will produce opposite polarities of magnetization dependent upon whether the wire to be pulsed in a given direction, is led above or below the cross. The wire for pulsing a given character may be led through one pole piece magnetic circuit after another in a strip module above or below the cross to produce the desired direction of polarization, in each element. In the same manner, the threading of an energizing winding is led from one end to end arranged strip module to another and so on to provide the winding for a character in the whole array. The next winding may be led through the members 18 – 22 in the same manner with the selective decision of placing the wire above or below the cross made at each cross. This process may therefore be continued until all the windings are inserted. The modules may then be rotated, as previously described, and arranged side by side in an array. As previously explained, the term 'winding' herein is used in a sense to include fractional turns only, in other words, a wire which does not completely encircle the magnetic circuit. It should be noted however, that in the arrangement shown, where the magnetic circuit is wound about the energizing winding (either above or below the crossing 'X') instead of vice versa; the result of analysis shows that the arrangement is the equivalent of a full single turn.

In accord with the invention, the strip members are designed to be coupled by a coupling member extending longitudinally transversely across each end of the strip modules when these are side by side in close proximity. Thus arranged, the coupling members hold the strip modules as a unit to form the array.

Two methods of coupling the strip modules are shown.

One method is shown in FIGS. 5 and 6. The strip module at each end may be provided with an extremity 24 extending rearwardly, about a 180° hairpin curve 26 in a direction endwise from the module turn and then forwardly. The extremity, thus curved, defines a rearwardly extending slot 28 designed to receive a coupling member extending transverse to the strip module through, and on each side of the slot 28 and inserted rearwardly into the slot. The outer end of the slot is wide enough to receive the relevant dimension of a rod-like member, tapers somewhat into a constructed portion 30 and widens at its innermost end into a space 32 to receive the rod-like member. The material forming the hairpin 26 and the adjacent extents is made slightly resiliently yieldable and is made thin enough to allow this, while a forwardly directed slot 34 is provided open to the rear of the strip module, separating the material from the body of the strip member to add to its resilient yieldability.

As shown in FIGS. 5 and 6 there is a base 36 for the array whereon a pair of rods 38 extend across each end of the base located and arranged to clip into the slot 28 and rest in space 32 at each end of the module. The rods 38 are made as long as required to receive the number of side by side strip modules forming the array. Thus the strip modules, arranged end to end, may be provided with pole pieces and energizing windings as schematically indicated in FIG. 3. One by one the strip modules may then be laid behind the rods and clipped forward into place, each strip module at the same time being rotated or with its energizing winding 180° relative to the one previous, in a sense to bring the modules into side by side relationship and the modules clipped into place on the rods. The array then appears as shown in FIG. 5.

As an alternative, it will be noted that the lengthwise outer edge of the hairpin member at each end is provided with a groove 42 transverse to the strip module direction. A base 43 for the array, shown in broken form in FIG. 7 is provided at with opposed walls 45 arranged to extend transverse to the longitudinal extension direction of the strip modules. As the cross-section of FIG. 7 indicates, the walls 47 are shaped to define opposed inwardly directed edges 44 shaped and spaced to be received within the grooves 42. Thus the strip modules, provided with windings and pole pieces as previously discussed, may, as indicated in FIG. 7, be clipped onto the inwardly directed opposed edges 44 of such an array base, the resiliency of the hairpin extremities 24, facilitating the yielding of the extremities to allow clipping the modules in place. The edges 44 with walls 45 extend transversely a sufficient distance to receive and couple the required number of the strip modules side by side in an array.

It will be noted that either of these attachment means may be provided separately since only one will be used with a given assembly; or that other transversely extending means may be used for coupling the elements together, although the two methods shown are preferred. In the examples given, the coupling members are rigid and the strip modules coupled to them by the resiliently yieldably form of the extremities. It will be obvious that this may be reversed and the coupling be achieved by the use of a rigid module with flexibility for coupling in the transverse coupling member. Similarly with the embodiment of FIG. 7, the coupling parts may be reversed, that is an edge may be molded into each extremity 24 while members similar to walls 45 could be provided with grooves arranged to receive the extremity edges.

I claim:

1. An array of display elements wherein each element comprises:

a flat element, contrastingly coloured on opposite sides, rotatably mountable on a base to rotate about an axis approximately parallel to the surface of the flat element, a magnet mountable on said flat element, defining a magnetic polar axis transverse to said rotational axis, a pair of pole pieces mounted on said base to project in such proximity to the locus of said magnet rotating on said element, that a magnetic field created by the pole pieces will affect the orientation of said magnet, said pole pieces being selected of material whose magnetic polarity is reversible, a magnetic element located rearwardly of said base joining said pole pieces in a magnetic circuit, a single row of said bases being connected in longitudinally extending row corresponding to a row of elements in said array, to form strip modules, said strip modules being designed and constructed to be coupled side by side in close proximity to form an array of said elements, the portion of the magnetic circuit rearward of the case is formed to provide, as viewed in the longitudinal extension direction of the element, spaced extents extending away from the base, crossing, then meeting to form a bight, and first means for carrying an electric current pulse in one direction, said first means inserted between said spaced extents on one side of the crossing of said extents will create one magnetic polarity in said pole pieces and second current carrying means inserted between said spaced extents on the other side of the crossing of said extents will create the opposite magnetic polarity in said pole pieces, said spaced extents being designed on either side of said crossing to receive at least one energizing current carrying means therebetween.

2. A plurality of longitudinally extending mounting elements, designed to mount in a single row, a plurality of magnetically actuable display elements, each said row mounting element being designed to be located side by side and in close proximity to other row mounting elements of the same type, each row mounting element at each end being provided with coupling means designed to couple said element to a member extending transversely thereof, said coupling elements and said transversely extending member being so arranged that a plurality of said coupling elements located side by side may be coupled to such a transversely extending member at each end, said row mounting elements being designed, to mount a pair of magnetic pole pieces for each magnetically actuable display element, each said pair of pole pieces being joined in a magnetic circuit rearwardly of said longitudinally extending element by a magnetic coupling member, said pole pieces being selected at material whose magnetic polarity is reversible, wherein the portion of the magnetic circuit rearward of the base is formed to provide, as viewed in the longitudinal extension direction of the element, spaced extents extending away from the base, crossing, then meeting spaced from said crossing, to form a bight, and first means for carrying an electric current pulse in one direction, said first means inserted between said spaced extents on one side of the crossing of said extents will create one magnetic polarity in said pole pieces and second current carrying means inserted between said spaced extents on the other side of the crossing of said extents will create the opposite magnetic polarity in said pole pieces, said spaced extents being designed on either side of said crossing to receive at least one energizing current carrying means therebetween.

3. Assembly for a display or indicating element comprising:

a longitudinally extending row mounting member, said row mounting member being shaped to mount on one side thereof, a plurality of magnetically actuable rotatable visual elements arranged in a single row in the longitudinal extension, said row mounting member being designed to mount a pair pole pieces corresponding to each visual element, and arranged to control the orientation thereof, said row mounting member being so designed that a plurality thereof will lie side by side in close juxtaposition, a pair of coupling members, one designed to lie adjacent each end of and to extend in a direction transverse to a row mounting member when juxtaposed side by side with other row mounting members, means for coupling said row mounting member at each end to the adjacent ones of said coupling members, whereby said coupling members retain said row mounting member in an assembled array, wherein a pair of pole pieces are provided corresponding to each visual element and each said pair of pole pieces is adapted to be linked to the other side of said mounting member by a magnetic element, forming with said pole pieces a magnetic circuit, said pole pieces being selected of a material whose magnetic polarity is reversible, wherein the magnetic joining member and pole pieces are formed to provide, viewed in the longitudinal extension direction of the element, spaced extents extending away from the row mounting member, crossing and meeting, spaced from said crossing, at a bight, and first means for carrying an electric current pulse in one direction said first means inserted between said spaced extents on one side of the crossing of said extents will create one magnetic polarity in said pole pieces and second current carrying means inserted between said spaced extents on the other side of the crossing of said extents will create the opposite magnetic polarity in said pole pieces, said spaced extents being designed on either side of said crossing to receive at least one energizing current carrying means therebetween.

4. An array of display elements wherein each element comprises:

a flat element, contrastingly coloured on opposite sides, rotatably mountable on a base to rotate about an axis approximately parallel to the surface of the flat element, a magnet mountable on said flat element, defining a magnetic polar axis transverse to said rotational axis, a pair of pole pieces mounted on said base to project in such proximity to the locus of said magnet rotating on said element, that a magnetic field created by the pole pieces will affect the orientation of said magnet, said pole pieces being selected of a material whose magnetic polarity is reversible, a magnetic element located rearwardly of said base joining said pole pieces in a magnetic circuit, a single row of said bases being connected in longitudinally extending row corresponding to a row of elements in said array, to form strip modules, said strip modules being designed and constructed to be coupled side by side in close proximity to form an array of said elements, wherein the magnetic circuit rearwardly of the array is shaped to provide, when viewed longitudinally of the element, rearwardly extending limits from each pole piece, crossing and meeting to form a bight, defining, when viewed in said longitudinal direction, two spaces between said bight and the rearward portion of the array, said spaces being separated by said crossing, and means inserted through the two spaces carrying electric current pulses in the same direction relative to the longitudinal direction of the element to produce opposite magnetization in said magnetic circuit.

5. A plurality of longitudinally extending mounting elements, designed to mount in a single row, a plurality of magnetically actuable display elements, each said row mounting element being designed to be located side by side and in close proximity to other row mounting elements of the same type, each row mounting element at each end being provided with coupling means designed to couple said element to a member extending transversely thereof, said coupling elements and said transversely extending member being so arranged that a plurality of said coupling elements located side by side may be coupled to such a transversely extending member at each end, said row mounting elements being designed, to mount a pair of magnetic pole pieces for each magnetically actuable display element, each said pair of pole pieces being joined in a magnetic circuit rearwardly of said longitudinally extending element by a magnetic coupling member, said pole peices being selected of a material whose magnetic polarity is reversible, wherein the magnetic circuit rearwardly of the array is shaped to provide, when viewed longitudinally of the element, rearwardly extending extents from each pole piece, crossing and meeting to form a bight, defining, when viewed in said longitudinal direction, two spaces between said bight and the rearward portion of the array, said spaces being separated by said crossing, energizing means designed for insertion through said spaces whereby the sense of the turns in each such magnetic circuit being such that said energizing means through the two spaces for carrying current in the same direction relative to the longitudinal direction of the element will produce opposite magnetization.

* * * * *